US005089942A

United States Patent [19]

Sekiguchi

[11] Patent Number: 5,089,942

[45] Date of Patent: Feb. 18, 1992

[54] HEAD LAMPS UNIT WITH MULTIPLE PASSING BEAM FILAMENTS PROVIDING IMPROVED PASSING BEAM

[75] Inventor: Tsuneo Sekiguchi, Tokyo, Japan

[73] Assignee: Stanley Electric Co., Ltd., Tokyo, Japan

[21] Appl. No.: 684,046

[22] Filed: Apr. 11, 1991

[30] Foreign Application Priority Data

Apr. 20, 1990 [JP] Japan ..... 2-42143[U]

[51] Int. Cl.[5] ..... F21M 3/14

[52] U.S. Cl. ..... 362/214; 362/61; 362/247; 362/263

[58] Field of Search ..... 362/61, 80, 211, 214, 362/240, 263, 305, 310, 247

[56] References Cited

U.S. PATENT DOCUMENTS 4,498,124 2/1985 Mayer et al. ..... 362/247 X 4,523,262 6/1985 Shinkai ..... 362/61 X

*Primary Examiner*—Stephen F. Husar

*Attorney, Agent, or Firm*—Frishauf, Holtz, Goodman & Woodward

[57] ABSTRACT

A head lamp unit includes two lighting fixtures, each of which includes a running beam filament and a passing beam filament, for selectively producing a running light beam and a passing light beam. The light distribution characteristic of the passing light beam of one of the lighting fixtures is arranged to be symmetrical to the left and right, whereas the light distribution characteristic of the passing light beam of the other lighting fixture is arranged to be asymmetrical to the left and right, to thereby provide an improved passing light beam.

10 Claims, 3 Drawing Sheets

HEAD LAMPS UNIT WITH MULTIPLE PASSING BEAM FILAMENTS PROVIDING IMPROVED PASSING BEAM

BACKGROUND OF THE INVENTION

1. Field of the Invention

The present invention relates to a head lamp unit for an automobile, and more specfically, to a head lamp used in a 4-lamp system in which two lighting fixtures constitute one lighting fixture unit.

2. Description of the Prior Art

An example of a conventional head lamp unit 90 of the kind mentioned above is shown in FIG. 7. For example, a reflecting mirror 92*a* and a bulb 92*b* of one lighting fixture 92 and a reflecting mirror 93*a* and a bulb 93*b* of the other lighting fixture 93 are disposed behind a lens 91. The aforementioned one lighting fixture 92 employs a bulb 92*b*, for example, such as an H4 halogen bulb provided with a filament for a running beam and a filament for a passing beam, whereas the other lighting fixture 93 employs a bulb 93*b*, for example, such as an Hl halogen bulb provided only with a filament for a running beam.

With this conventional arrangement, when the vehicle runs with the passing beam operative, one lighting fixture 92 is lit whereas the other lighting fixtures 93 is not lit.

In case of the aforesaid passing mode, the light distribution characteristic, in the left-side passing, is asymmetric to the left and right in order to easily read a road sign or the like on the left side of the road. Portions opposite to the lighting fixtures 92 and 93 of the lens 91 are applied with lens cuts corresponding thereto to make adequate the light distribution characteristic of the lighting fixtures 92 and 93.

However, in the conventional head lamp 90 constructed as described above, when the vehicle runs with the passing light beam, lighting becomes unavoidably darker than when running with the running beam. Furthermore, a hood is provided at a lower half portion of the filament for the passing beam to shape the light distribution characteristic so that approximately one half of the light is shielded, which further causes poor illumination. This gives rise to a problem of failing to meet today's traffic circumstances in which running in the passing beam mode is compelled to be choosen during a major portion of night running even on an express road with much traffic. This problem should be solved.

For solving the aforesaid problem, a proposal has been made in which filaments for the passing beam are provided on both of the aforesaid lighting fixtures 92 and 93, respectively. In this case, however, asymmetric light distribution characteristics E1 and E2 become doubled, as shown in FIG. 8. It becomes extremely difficult to arrange the respective light distributions E1, E2 to meet each other to provide trouble-free light distribution characteristics in practical use. Thus, this arrangement fails to constitute a satisfactory solution to the problem.

SUMMARY OF THE INVENTION

For solving the aforementioned problem encountered in prior art, the present invention provides a head lamp in which one head lamp unit is comprised of two lighting fixtures, and a running beam and a passing beam can be switched, wherein passing beam filaments are disposed on both of the respective lighting fixtures of said head lamp unit, and when the running beam is switched to said passing beam, one light distribution characteristic of the lighting fixture is symmetrical to the left and right whereas the other light distribution characteristic is asymmetrical to the left and right. According to the present invention, even at the time of lighting with the passing beam, the head lamp unit provides sufficient lighting, thus solving the aforesaid conventional problem.

DETAILED DESCRIPTION OF THE INVENTION

Figure 1:
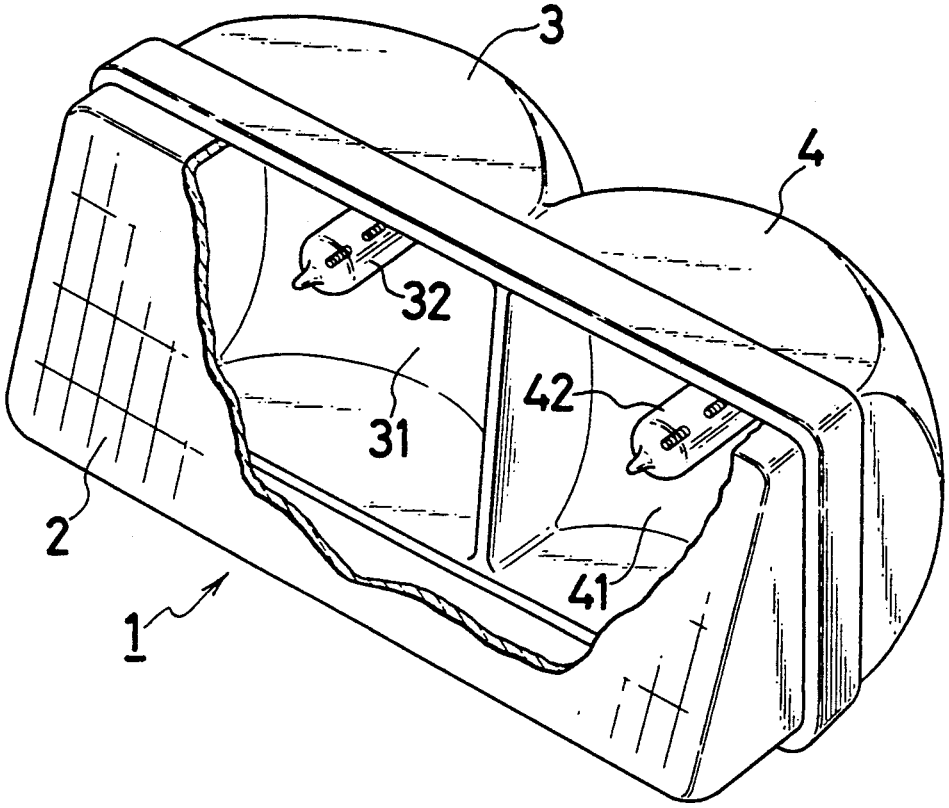
FIG. 1 is a perspective view showing, in a partly cutaway form, one embodiment of a head lamp unit, according to the present invention.

The present invention will now be described in detail with reference to one embodiment shown in the drawings.

Figure 2:
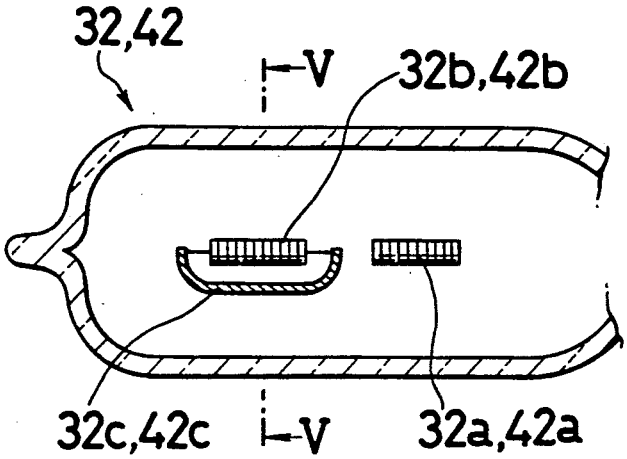
FIG. 2 is a schematic sectional view showing a portion of a bulb used in the embodiment of FIG. 1.

A head lamp unit 1 according to the present invention is shown in FIG. 1 and comprises a lens 2 having a back surface behind which is provided two lighting fixtures 3 and 4, one of the lighting fixtures 3 including a reflecting mirror 31 and a bulb 32, and the other lighting fixture 4 including a reflecting mirror 41 and a bulb 42, similarly to the conventional head lamp unit. In the present invention, however, as shown in FIG. 2, the bulb 32 of one lighting fixture 3 as well as the bulb 42 of the other lighting fixture 4 both have filaments 32*a* and 42*a* for a running beam and filaments 32*b* and 42*b* for a passing beam, for example, such as H4 halogen bulbs. Hoods 32*c* and 42*c* are disposed at one half portions of the filaments 32*b* and 42*b* for the passing beam, as in the prior art.

In addition to the aforesaid construction, in the present invention, the lighting fixtures 3 and 4 are different from each other in the light distribution characteristic of the passing beam. For example, in one lighting fixture 3, a left and right asymmetric light distribution characteristic D1 for the left-side passing shown in FIG. 3 is used, and in the other lighting fixture 4, a left and right symmetric light distribution characteristic D2 shown in FIG. 4 is used.

Figure 4:
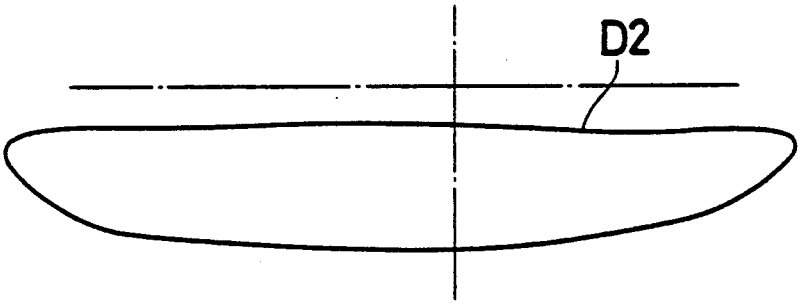
FIG. 4 is likewise an explanatory view showing the light distribution characteristic of a passing beam of the other lighting fixture in the embodiment of FIG. 1.
Figure 5:
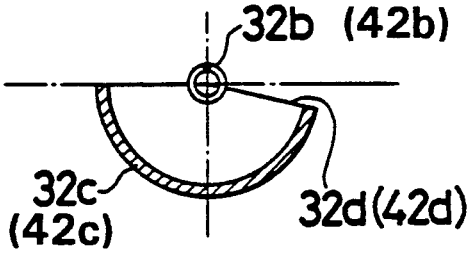
FIG. 5 is a sectional view taken on line V—V in FIG. 2.

The structure for obtaining the left and right asymmetric light distribution characteristic D1 of FIG. 3 and the left and right symmetric light distribution characteristic D2 of FIG. 4 in the actual embodiment will be described in detail with the reference to the bulb 32 (or 42) which is, for example, the H4 halogen bulb shown in FIG. 2. A hood 32*c* provided on the filament 32*b* for the pass-each-other beam of the bulb 32 is provided with a cut-out portion 32*d* downwardly inclined at a suitable angle on the right side as viewed from the direction of a socket as shown in FIG. 5 in order to obtain the essential left and right asymmetric light distribution characteristic. A similar hood 42*c* with a cut-out portion 42*d* is provided for filament 42*b* as seen in FIG. 5.

Figure 3:
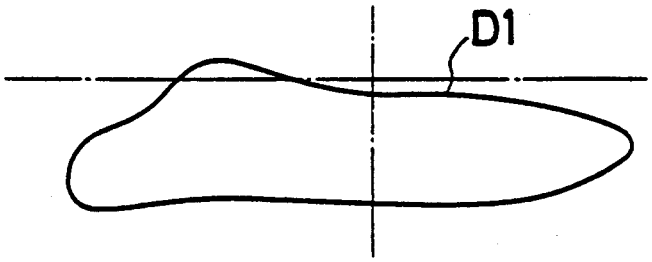
FIG. 3 is an explanatory view showing the light distribution characteristic of a passing beam of one lighting fixture in the embodiment of FIG. 1.

Thereby, in one lighting fixture 3, the bulb 32 is mounted in the direction as determined whereby light is placed in contact with the lower half portion of the reflecting mirror 31 by the portion of the cut portion 32*d* to obtain the left and right asymmetric light distribution characteristic D1 which irradiates the left side of the road (see FIG. 3).

In the other lighting fixture 4, the bulb 42 is rotated through a suitable angle to distribute the cut portion 42*d* to the left and right, whereby the left and right symmetric light distribution characteristic D2 (see FIG. 4) can be easily obtained. In this case, if the reflecting mirror 41 is suitably adjusted to be set so that the mirror 41 is directed downward, upwardly directed light which is harmful to a passing beam is never emitted.

Figure 6:
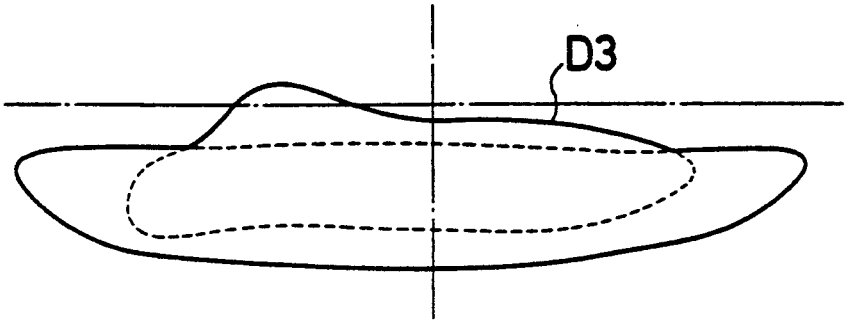
FIG. 6 is an explanatory view showing the overall light distribution characteristic of the embodiment of FIG. 1.
Figure 7:
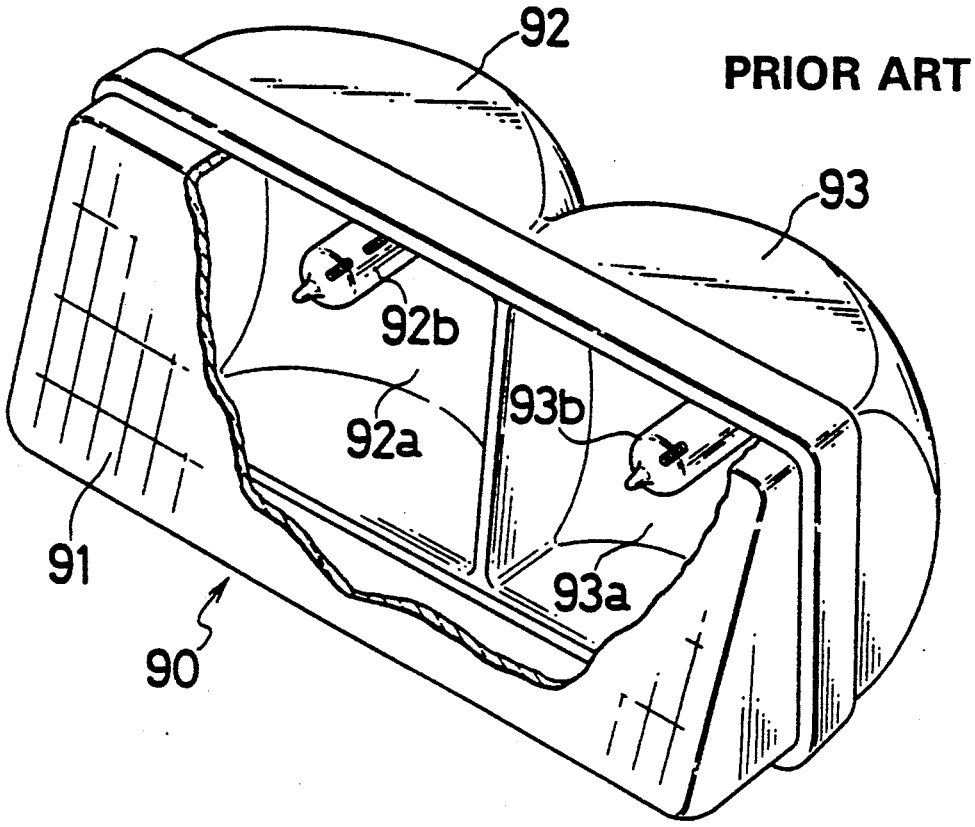
FIG. 7 is a perspective view, partly cutaway, showing a conventional head lamp unit.
Figure 8:
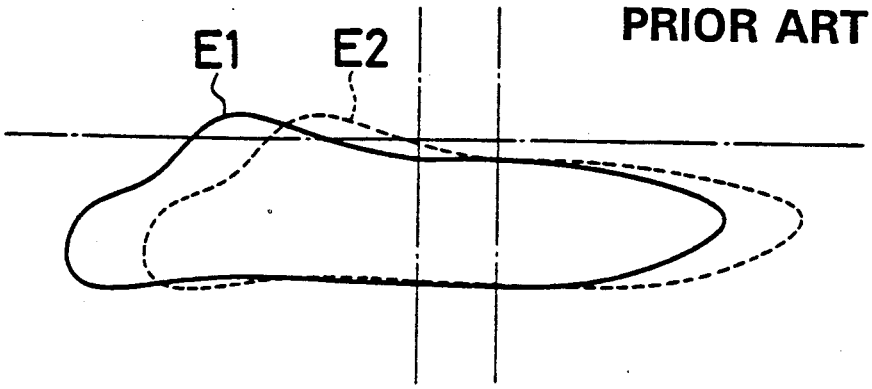
FIG. 8 is an explanatory view showing the light distribution characteristic of the conventional head lamp unit of FIG. 7.

The operation and effect of the head lamp 1 according to the present invention constructed as described above will be explained hereinafter. According to the present invention, one lighting fixture 3 and the other lighting fixture 4 are both provided with the respective filaments 32*b* and 42*b* for a passing beam, and one lighting fixture 3 is arranged to provide the left and right asymmetric light distribution characteristic D1 FIG. 3 whereas the other lighting fixture 4 is arranged to provide the left and right symmetric light distribution characteristic D2 of FIG. 4. With this arrangement, when both light distribution characteristics D1 and D2 are placed or superposed one over the other to obtain the overall light distribution characteristic D3 as shown in FIG. 6, a position at which both the light distribution characteristics D1 and D2 are placed one over the other is large in freedom, such that a deviation in a horizontal direction thereof is allowed to a considerable degree, thus substantially requiring no adjustment.

As described above, according to the present invention, one lighting fixture and the other lighting fixture of a head lamp unit are both provided with filaments for a passing beam, and one lighting fixture is for the left and right asymmetric light distribution characteristic whereas the other lighting fixture is for the left and right symmetric light distribution characteristic. With this arrangement, even in the case where the filament for the passing beam is provided on both of the lighting fixtures, when both of the light distribution characteristics are placed or superposed one over the other to provide the overall light distribution characteristic, precise adjustment need not be particularly made. Thereby, the head lamp unit in which a filament for the passing beam is provided on both of the lighting fixtures thereof can be put to practical use, which meets today's traffic circumstances, thus providing an excellent effect in improving traffic safety by the enhancement of visibility.

What is claimed is:

1. A head lamp unit comprising:

first and second lighting fixtures arranged to form a single head lamp unit, said lighting fixtures being selectively energized to produce light beams;

each of said lighting fixtures of said single head lamp unit comprising a running light beam filament for producing a running light beam and a passing light beam filament for producing a passing light beam;

said filament of each of said lighting fixtures of said single head lamp unit being selectively operable to selectively produce said running beam and said passing beam;

said first lighting fixture comprising light characteristic modifying means, including light directing means mounted adjacent the passing light beam filament thereof, for causing the passing light beam emitted by said passing light beam filament of said first lighting fixture to have a light distribution characteristic which is symmetrical to the left and right side directions; and said second lighting fixture comprising light characteristic modifying means, including light directing means mounted adjacent the passing light beam filament thereof, for causing the passing light beam emitted by said passing light beam filament of said second lighting fixture to have a light distribution characteristic which is asymmetrical to the left and right side directions.

2. A head lamp unit according to claim 1, wherein each of said first and second lighting fixtures comprises a single bulb having said running and passing filaments therein.

3. A head lamp unit according to claim 2, wherein said single bulb is an H4 halogen bulb.

4. A head lamp unit according to claim 1, wherein said light directing means of each of said lighting fixtures comprises a hood provided adjacent to the respective passing light beam filament.

5. A head lamp unit according to claim 4, wherein the hood of said second lighting fixture is provided with a cut-out portion inclined downwardly at an angle on the right side thereof so as to allow light to pass at said right-side cut-out portion without being deflected by said hood to thereby obtain said asymmetrical light characteristic.

6. A head lamp unit according to claim 5, wherein the hood of said first lighting fixture has a cut-out portion and is rotated to a given angle to distribute said cut-out portion symmetrically to the left and right to thereby obtain said left and right side symmetrical light characteristic.

7. A head lamp unit according to claim 4, wherein each of said first and second lighting fixtures comprises a single bulb having said running and passing filaments therein.

8. A head lamp unit according to claim 7, wherein said single bulb is an H4 halogen bulb.

9. A head lamp unit according to claim 7, wherein said hood of at least said second lighting fixture is provided with a cut-out portion inclined downwardly at an angle on the right side thereof so as to allow light to pass at said right-side cut-out portion without being deflected by said hood to thereby obtain said asymmetrical light characteristic.

10. A head lamp unit according to claim 9, wherein the hood of said first lighting fixture has a cut-out portion, and is rotated to a given angle to distribute said cut-out portion symmetrically to the left and right side to thereby obtain said left and right side symmetrical light characteristic.

* * * * *